United States Patent [19]

Salsbury et al.

[11] Patent Number: 4,823,707

[45] Date of Patent: Apr. 25, 1989

[54] APPARATUS FOR COVERING AN OPEN-TOPPED VEHICLE

[76] Inventors: H. Allen Salsbury, 8212 NW. Delta, Kansas City, Mo. 64151; Gary E. Wymer, 5915 W. 88th Terrace, Overland Park, Kans. 66207

[21] Appl. No.: 165,073

[22] Filed: Mar. 7, 1988

[51] Int. Cl.[4] ..... B61D 39/00

[52] U.S. Cl. ..... 105/377; 220/359; 296/100; 296/104

[58] Field of Search ..... 105/377, 355; 296/100, 296/104; 220/359; 215/232; 383/101; 53/442, 478

[56] References Cited

U.S. PATENT DOCUMENTS

| | | | |
|---|---|---|---|
| 722,873 | 3/1903 | Mutch . | |
| 894,759 | 7/1908 | Stevens . | |
| 2,969,284 | 1/1961 | Ambli . | |
| 2,991,524 | 7/1961 | Dobrikin . | |
| 3,017,729 | 1/1962 | Cheeley | 53/478 |
| 3,041,104 | 6/1962 | Richard | 296/100 |
| 3,044,653 | 7/1962 | Tantlinger | 105/377 X |
| 3,330,225 | 7/1967 | Barry . | |
| 3,494,658 | 2/1970 | Maes, Jr. . | |
| 3,614,154 | 10/1971 | Evans | 296/100 |
| 3,628,720 | 12/1971 | Schmedding | 383/101 |
| 3,951,447 | 4/1976 | Sharp | 105/377 X |
| 4,018,337 | 4/1977 | Barnett | 53/442 X |
| 4,248,475 | 2/1981 | Johnson | 296/100 |
| 4,625,654 | 12/1986 | Kuss et al. . | |
| 4,657,062 | 1/1987 | Tuerk . | |

FOREIGN PATENT DOCUMENTS

| | | | |
|---|---|---|---|
| 114087 | 11/1941 | Australia | 296/100 |
| 3036479 | 9/1982 | Fed. Rep. of Germany | 296/100 |
| 3999 | of 1885 | United Kingdom | 105/377 |

*Primary Examiner*—Johnny D. Cherry
*Assistant Examiner*—F. Williams
*Attorney, Agent, or Firm*—Litman McMahon & Brown

[57] ABSTRACT

An open-topped vehicle, such as a freight vehicle, is covered by a single-use covering which includes a cage having a standard length and adjustment elements for taking up the difference between the cage length and the length of the vehicle. The cage includes cover supporting ribs that are spaced apart from each other according to preset distances. The covering also includes a flexible cover that is shrinkable and self-weldable upon the application of heat thereto, and is attached to the vehicle by multi-ply end joints which are formed by welding a first portion of the cover to a second portion of the cover to form a hem with a line located inside the hem. The line is attached to the vehicle. Patches can also be placed in locations on the cover needing additional, multi-ply protection.

15 Claims, 3 Drawing Sheets

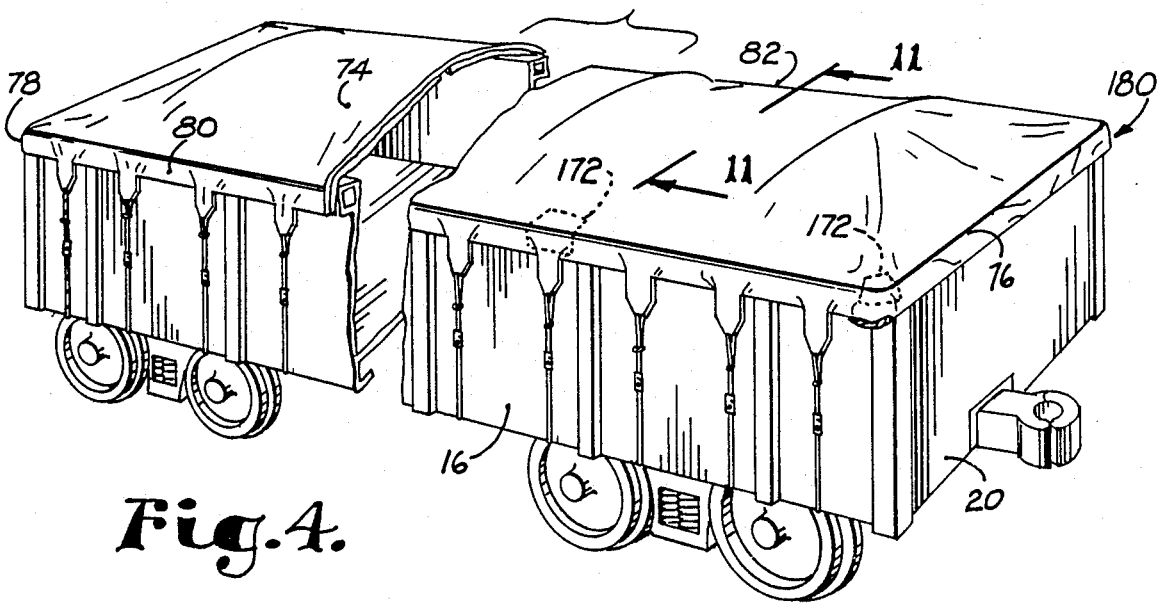
Fig. 4.
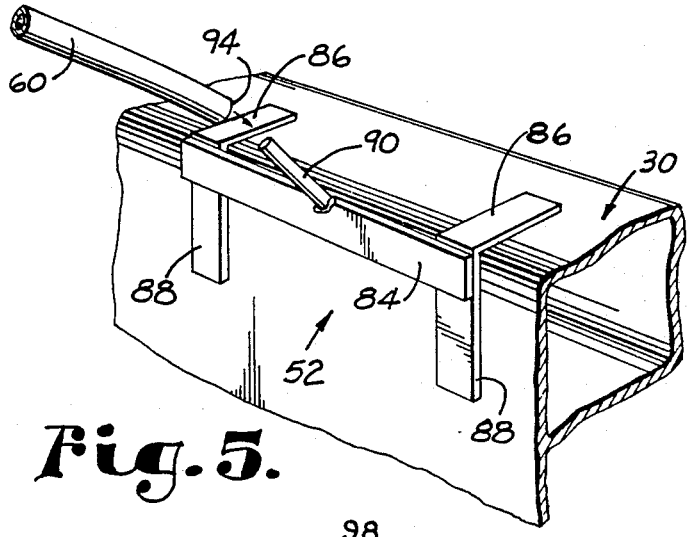
Fig. 5.
Fig. 9.
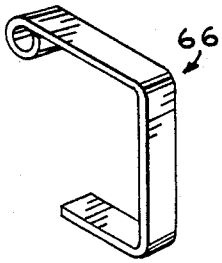
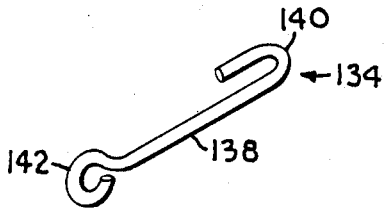
Fig. 10.
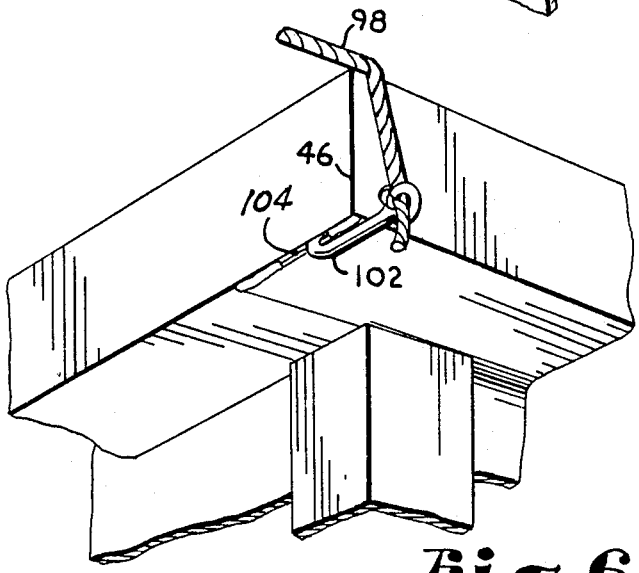
Fig. 6.

APPARATUS FOR COVERING AN OPEN-TOPPED VEHICLE

BACKGROUND OF THE INVENTION

1. Field of the Invention

The present invention relates in general to covering open-topped vehicles, and in particular to covering open-topped freight vehicles. Specifically, the present invention relates to covering open-topped freight vehicles in a secure, yet efficient manner.

2. Description of the Prior Art

In recent years, it has become desirable to ship materials such as grain, granular materials, and the like that are subject to degradation or spoilage if exposed to the weather. Even many scrap and metal products should not be exposed to weather during shipping. Some products, such as sand or the like, while not subject to damage from the weather are still best not exposed during shipping due to the possibility that such materials may fly off of the freight vehicle and become a nuisance. Crushed-rock ballast is commonly stored and transported by railroads in ballast cars with open tops and bottom dispensing hoppers. Ballast is used year-round for track bed repair, but in icing conditions the ballast can freeze into a solid, unusable mass.

Since, for many reasons, it is easy to ship materials, such as mentioned above, in open-topped freight vehicles, such vehicles have received wide acceptance. However, due to the just-mentioned problems, as well as other requirements, such vehicles should be covered during the transportation of the material, and possibly also covered while the material is being stored in the vehicle if such storage is performed. Present open-topped freight vehicles come in many designs, and one example of such vehicles is the so-called gondola car. A gondola car is a flat-bottomed railroad car which has no top, fixed sides and often has removable ends, and is used to ship steel, rocks or heavy bulk commodities. Other examples of such open-topped vehicles include ballast cars, hopper cars and flat cars. Of course, other examples of such vehicles will occur to those skilled in the art based on the disclosure herein. Due to the possible variations in such vehicles, the dimensions of the vehicles can be subject to wide variations. In fact, vehicles of the same type, such as the just-mentioned gondola car, may have dimensions that vary among the vehicles of that same type. Thus, not all gondola cars have the same axial length, and so forth.

With regard to covering such vehicles, it is noted that many requirements exist. For example, the cover must be strong enough and mounted securely enough to resist coming off of the vehicle when subject to a strong wind as may occur during transit at high speeds, or as may occur if the vehicle encounters a strong wind storm. Such wind may find its way beneath the cover and thus lift it from the vehicle. Such strong wind may also tend to rip the cover and thus exacerbate the just-mentioned problem by establishing further paths for the wind to get beneath the cover.

However, these mounting and strength requirements are not easily satisfied as the cover must be mounted in place in an efficient manner, often in extremely harsh weather conditions. Thus, a cover that is made strong merely by having a great deal of material may not satisfy the total requirements as it may be expensive and also may be difficult to mount. Still further, a cover that is securely mounted may not satisfy the requirements of being efficient to mount in difficult weather conditions.

Basically, there are two choices when it comes to covering such open-topped vehicles: (1) a permanently attached cover; and (2) a temporary cover, or cover that is basically designed to be a single-use cover. Each of these choices has its advantages and each has its own particular drawbacks.

For example, while a permanent cover has the advantage of being adapted to be "customized" for a particular vehicle, it has a drawback associated with being expensive due to "loss" of the cover. "Loss" can occur due to handling or due to general degradation as a result of exposure to harsh weather conditions. If a vehicle having a permanent cover thereon is stored after use in a manner that does not lend itself to further use of the vehicle to carry the material for which the cover is most effective, the covered vehicle might be considered as being "lost".

Accordingly, some of the advantages of the permanently covered vehicle, especially the economic advantages, which are gained by making multiple uses of a single piece of equipment are vitiated if not entirely lost due to the "loss" of the cover. In any case, if the cover is made strong and secure but must be expensive to build or to use in order to accomplish this result, it is not a totally successful design.

On the other hand, a single-use cover can overcome some of the above-mentioned drawbacks of the permanent cover. For example, such a single-use cover is not as subject to degradation due to weather, is not as subject to expense due to a lack of multiple uses, and is not as likely to have a design requirement for multiple and varied uses as is the permanently attached cover. Accordingly, some of the problems associated with permanent covers are overcome by the single-use cover. By its basic nature, a single-use cover is not subject to the above-mentioned drawbacks associated with "loss" of the cover.

However, in overcoming some problems, the single-use cover presents problems of its own.

For example, since a single-use cover is designed to be assembled each time it is used, therefore, any difficulties in assembly are magnified many times over those same difficulties associated with a permanently attached cover. Thus, time and ease of assembly become important considerations in single-use covers.

Still further, a single use cover is best sold as a kit to be stored and assembled as necessary. Thus, to be most effective, the single-use cover should be "universally adaptable". That is, the cover furnished in a single kit should be amenable for use on a variety of vehicle dimensions. If a single-use cover cannot be designed to be "universally" adaptable, many different single-use covers may be required to fit all of the different types of vehicles and even the different sized vehicles of the same type. A requirement for many different single-use cover kits may vitiate or even defeat many of the economic advantages of such a device as compared to a permanently mounted cover.

A permanently mounted cover can have the advantage of being designed especially for the vehicle upon which it is used to be securely mounted thereon and to be as strong as possible for that particular vehicle; whereas, a single-use cover sold in a kit may not be perfectly adapted to the particular vehicle being covered and some security in mounting and strength of the cover may be lost. Thus, again, universal use requires sacrificing some advantages associated with customizing of the cover to the particular vehicle.

Yet another drawback associated with single-use covers as compared to the permanently attached covers may be that of consistent results. That is, when a cover is permanently attached to a vehicle, yet has some limitations, the user of that vehicle is able to learn what those limitations are and can account for them in his planning. However, a single-use cover cannot generate such a history, so each cover may have its own particular quirks and problems which a user may not be able to account for in a preoccurrence manner.

Accordingly, there is a need for a single-use cover that can be quickly, yet securely mounted on a vehicle even under difficult weather conditions, yet is adaptable to a wide variety of vehicles and can be designed to be consistent and strong, and thereby realize many of the advantages of both a single-use cover as well as a permanently attached cover without being subject to all of the drawbacks associated with each of such cover designs.

OBJECTS OF THE INVENTION

It is a main object of the present invention to cover an open-topped vehicle in a secure manner.

It is another object of the present invention to provide a single-use cover for covering an open-topped vehicle in an efficient and secure manner.

It is another object of the present invention to provide a single-use cover for an open-topped vehicle that is amenable to use with a variety of different vehicle sizes.

It is another object of the present invention to provide a single-use cover for an open-topped vehicle that can be mounted in a manner to consistently produce design results.

It is a specific object of the present invention to provide a single-use cover for use on gondola, hopper and ballast railroad cars.

It is another specific object of the present invention to provide a single-use cover for use on railroad cars that is efficiently installed even under severe weather conditions, and can accommodate a variety of car dimensions yet will be securely mounted on the car.

It is another specific object of the present invention to provide a cover for railroad cars that is strong in the particular locations most likely to be damaged during use of the cover, yet is not wasteful of cover material.

SUMMARY OF THE INVENTION

These, and other objects, are accomplished by the vehicle covering means embodying the present invention which comprises a cover supporting means that includes a cage that can be produced at a factory to include the most efficient design, yet can be modified to account for dimensional variations of individual vehicles with which it will be used and can still be efficiently and securely set up.

Specifically, the covering means of the present invention comprises a cage formed of a plurality of ribs mountable on the side walls f an open-topped vehicle, and a ridge line means for establishing a preset spacing between those ribs in the set-up configuration. The covering means further includes an adjustment means for correcting the difference between the cage length and the length of the vehicle.

In this manner, the spacing between ribs, and, indeed, the ribs themselves, can be designed at the factory to be the most efficient configuration, yet any variances caused by variations in vehicle dimensions can be accommodated. A "universal" single-use covering means is thus provided. Since the cover is designed at a factory, its properties and the design properties thereof are uniform and its results can be viewed as being repeatable and consistent.

Still further, the covering means of the present invention includes a double-ply, flexible cover that has properties that permit it to be shrinkable and self-weldable by application of heat thereto, and is sized and shaped to form an overlapping flap on each end of the vehicle when the cover is placed on the cage. The covering means then includes end truss means that is associated with each end of the vehicle to tie the ends of the cover to the associated ends of the vehicle. Each truss means includes a line that will be positioned inside of a hem formed when the flap is folded back against the remainder of the cover. Since the cover is formed of material that is self-welding upon the application of heat, the application of heat to the thus formed hems will form a multi-ply joint at both ends of the vehicle. Some of the material from a flap can be removed and located over the corners of the vehicle, or any other location that may require extra reinforcement, and then heat welded in place to form multi-ply areas.

In this manner, those areas of the cover that are most likely to receive harsh treatment during use of the cover are reinforced by formation of multi-ply areas. This permits strengthening of the cover only in those areas and does not require the entire cover to be strengthened. Specifically, since the end joints are likely to encounter harsh wind conditions, this multi-ply configuration is most beneficial. The joint is continuous over essentially the entire width of the vehicle, and thus is not subject to the problems associated with attachment means, such as clamps, that only cover a limited portion of the area while leaving gaps between the attachment means. In this manner, the force exerted on the end of the cover is distributed throughout the multi-ply joint rather than on concentrated areas.

BRIEF DESCRIPTION OF THE DRAWINGS

FIG. 4 is a perspective showing the covering means of the present invention in place on a freight vehicle.

FIG. 5 is a perspective of a rib supporting bracket and a portion of a cover supporting rib used in the covering means of the present invention.

FIG. 6 is a perspective of an attachment means used in conjunction with the covering means of the present invention.

FIG. 9 is a perspective showing a C hook.

FIG. 10 is a perspective showing a GS hook.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
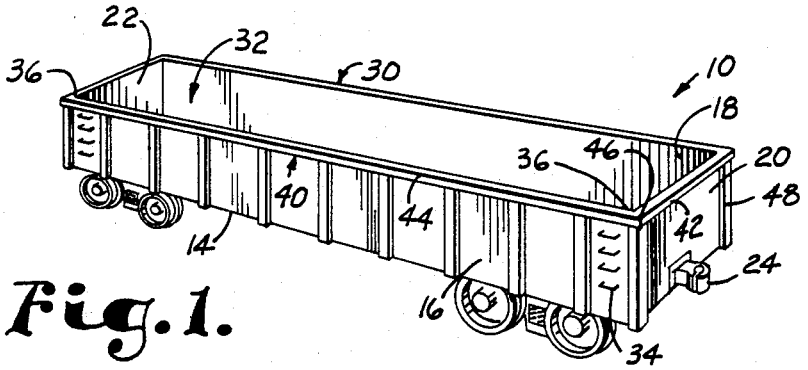
FIG. 1 is a perspective of an open-topped freight vehicle such as is covered by the covering means embodying the present invention.

Shown in FIG. 1 is an open-topped vehicle 10 of the type used to store and ship freight. Examples of such open-topped vehicles are gondola cars, flat cars, ballast cars, and hopper cars. However, other forms of such cars will occur to those skilled in the art, and accordingly, the present invention is not intended to be limited to the specific listing of open-topped vehicles just mentioned, but is applicable to any such open-topped vehicle.

Specifically, the open-topped vehicle 10 inherently includes a wheeled base 14 supporting upstanding side walls 16, 18 and upstanding end walls 20, 22. Couplings, such as coupling 24, are mounted on the end walls 20, 22 in the manner usual to such vehicles. The end walls 20, 22 and side walls 16, 18 terminate in a co-planar manner to form a top rim, such as indicated by the reference numeral 30 in FIG. 1. The walls 16, 18, 20 and 22 and base 14 of the vehicle 10 thus form a container volume, indicated generally by the reference numeral 32 in FIG. 1, and the usual ladders 34 and other such equipment are included on the vehicle 10. The ladders 34 are located adjacent to the corners, such as corner 36 formed by the intersection of side wall 16 and end wall 20. As shown in FIG. 1, the top rim 30 can include an overhang means 40 formed by end rim elements 42 and side rim elements 44 which intersect each other to form rim corners, such as rim corner 46. Corner and side wall reinforcement elements 48, 49 can also be included as necessary.

Figure 2:
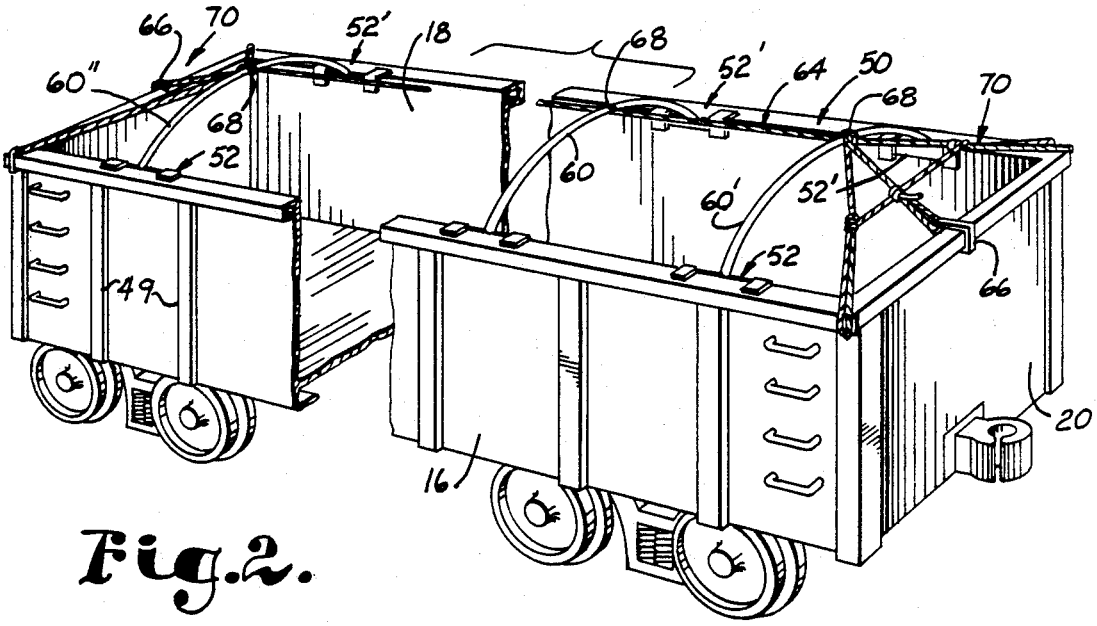
FIG. 2 is a perspective showing a cage of the covering means mounted on the freight vehicle.

Having described the general nature of the open-topped vehicle 10, reference is now made to FIG. 2 for a description of the cover means for such a vehicle as embodied in the present invention.

The cover means includes a cover supporting cage 50 of a standard length. This standard length is set according to the needs of the freight shipping industry and is uniform for each covering means. The cage 50 includes a plurality of side wall mountable rib supporting brackets, such as bracket 52, which are mounted on the side walls 16, 18 of the vehicle to form cooperative pairs. That is, each rib supporting bracket 52 on side wall 16 has a corresponding rib supporting bracket 52′ on the side wall 18. The rib supporting brackets 52, 52′ will be discussed in greater detail below.

The cover supporting cage 50 further includes a plurality of cover supporting ribs 60 each of which is spaced apart from adjacent ribs 60 along the axial length of the vehicle as measured between the end walls 20, 22. The spacing between the adjacent cover supporting ribs is preset at the factory to form a cover supporting cage 50 having the characteristics desired for best results in covering materials and the like commonly carried in open-topped vehicles. The ribs are preferably lengthwise arcuate and are sized to extend across the width of the vehicle as measured between the sides 16, 18. The cover supporting ribs are attached to the rib mounting brackets 52, and will be discussed in greater detail below.

The cover supporting means cage 50 further includes a ridge line means 64 which extends axially along the vehicle from end wall 20 to end wall 22 and is attached to those ends by attaching means, such as C hook 66, which may be bent into shape from a flat strip of metal (FIG. 9). The ridge line means 64 includes a plurality of rib attaching means 68 comprising knots for attaching the cover supporting ribs 60 thereto. In fact, the ribs are attached to the ridge line means at the factory, and thus, the ribs 60 could be considered as being part of the ridge line means 64. The rib attaching means are spaced apart along the axial length of the ridge line means, and are spaced apart by distances that are preselected to space the cover supporting ribs 60 apart from each other by the aforediscussed preset spacing. Thus, setting up the cage 50 with a spacing between cover supporting ribs that is equal to the design spacing is a simple matter as the ridge line means 64 can be used as a guide for such spacing. This feature will be more fully evident from the ensuing discussion. Most preferably, the ridge line means 64 is a rope-like element.

Accordingly, the cage means 50 is seen to include the rib supporting brackets 52, the ribs 60 and the ridge line means 64 to which the ribs are attached at preset spacings to define the standard length of the cage means.

The cover supporting means of the present invention further includes an adjustment and cover supporting means 70 adapted to connect each end of the cage to an associated end of the vehicle. Each adjustment and cover supporting means 70 is adjustable and connects the endmost rib, such as rib 60′, of the cage 50 to the end of the vehicle which is adjacent thereto in a manner which accounts for differences between the overall length of the cover supporting cage 50 as measured between endmost rib 60′ and the corresponding endmost rib 60″ on the end of the cage remote from endmost rib 60′ and the overall axial length of the vehicle. As many vehicles may have axial lengths which are different from other vehicles, and since the overall length of the cage 50 is standard, there should be some means for accounting for such variations so a standardized cover supporting cage can be used in a universal manner. The adjustment and cover supporting means serves this purpose. The adjustment and cover supporting means 70 is adjustable to be adapted to connect an endmost rib to the adjacent end of the vehicle in a manner that can vary from vehicle to vehicle so that the standard overall length of the cage can be used with all vehicle lengths. The adjustment and cover supporting means 70 will be more fully discussed below.

Figure 11:
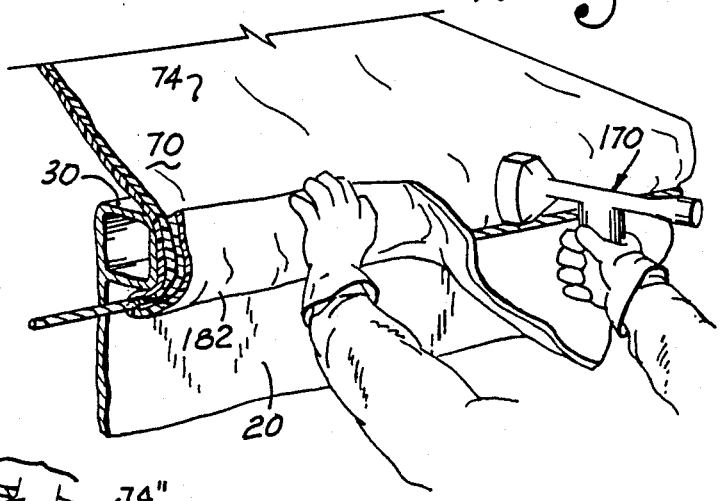
FIG. 11 is a fragmentary, vertical cross-section taken generally along lines 11—11 in FIG. 4 and particularly shows a cover condensation opening.
Figure 11:
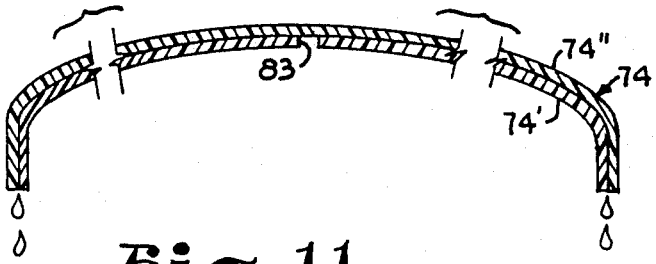

The covering means further includes a double-ply flexible cover 74 with inner and outer layers 74′, 74″, which are formed of a material (e.g. polyethylene) that permits the flexible cover 74 to be shrinkable and self-weldable upon the application of heat thereto. Such a cover is sold under the trademark TRAK PAK by the assignee of the present invention. The flexible cover 74 includes ends 76, 78 and sides 80, 82. The cover inner layer 74′ includes a condensation opening 83 (FIG. 11). Under certain operating conditions, moisture from a cargo in the vehicle 10 will cause relatively high humidity levels in the air trapped by the cover 74. The moisture-laden air can escape through the condensation opening 83, condense on the inner surface of the cover outer layer 74'', and trickle between the cover layers 74' and 74'' to the cover ends 76, 78 and sides 80, 82 for discharge. In transit, the air movement over the cover outer layer 74'' will, of course, lower its temperature and correspondingly increase the rate of condensation due to the temperature differential between the cooler cover outer layer 74'' and the warmer, moist air trapped thereunder. Thus, the cover 74 cooperates with the vehicle 10 to actually "dry" a cargo in transit. The ends of the flexible cover are adapted to correspond to the ends of the vehicle and the sides of the flexible cover are adapted to correspond to the sides of the vehicle. The flexible cover 74 will be more fully discussed below.

Referring next to FIG. 5, the rib supporting brackets 52 will be discussed in detail. As shown in FIG. 5, each bracket 52 includes an elongate base 84 with vehicle rim engaging legs 86 on each end of the base and vehicle side engaging legs 88 on each end of the base at locations corresponding to the locations of the rim engaging legs 86. If suitable, the side engaging legs 88 are longer than the rim engaging legs 86 to form a solid base for each bracket. Each bracket 52 further includes an arcuate rib engaging projection 90 mounted on the base 84 between the legs thereof to extend upwardly above the rim and toward the other side wall when the bracket is mounted on one of the side walls. The rib supporting brackets 52 are adapted to rest on the vehicle rim 30 with the side engaging legs 88 resting against the inner surface of the vehicle side walls. In this manner, the brackets can be easily set onto the vehicle and easily moved to accommodate the cage 50, yet will be securely mounted in place upon the in situ erection of the cage due to the downward and outward pressure exerted on the base 84 by the weight of the flexible cover and cover supporting rib 60 attached thereto as will be evident from the following discussion.

As is also shown in FIG. 5, the cover supporting ribs 1 60 are hollow adjacent to the ends 94 thereof. The hollow ends 92 of the ribs 60 are adapted to receive the arcuate rib engaging projections 90 to removably mount the ribs 60 onto each bracket 52. In this manner, the ribs 60 are quickly, yet securely mounted onto the vehicle via the brackets 52. The mounting of the brackets 52 onto the vehicle and the mounting of the ribs 60 to the brackets are such that the cage 50 can be quickly assembled in situ and can be quickly disassembled whereby the cover means of the present invention is a single-use cover for the vehicle.

Figure 3:
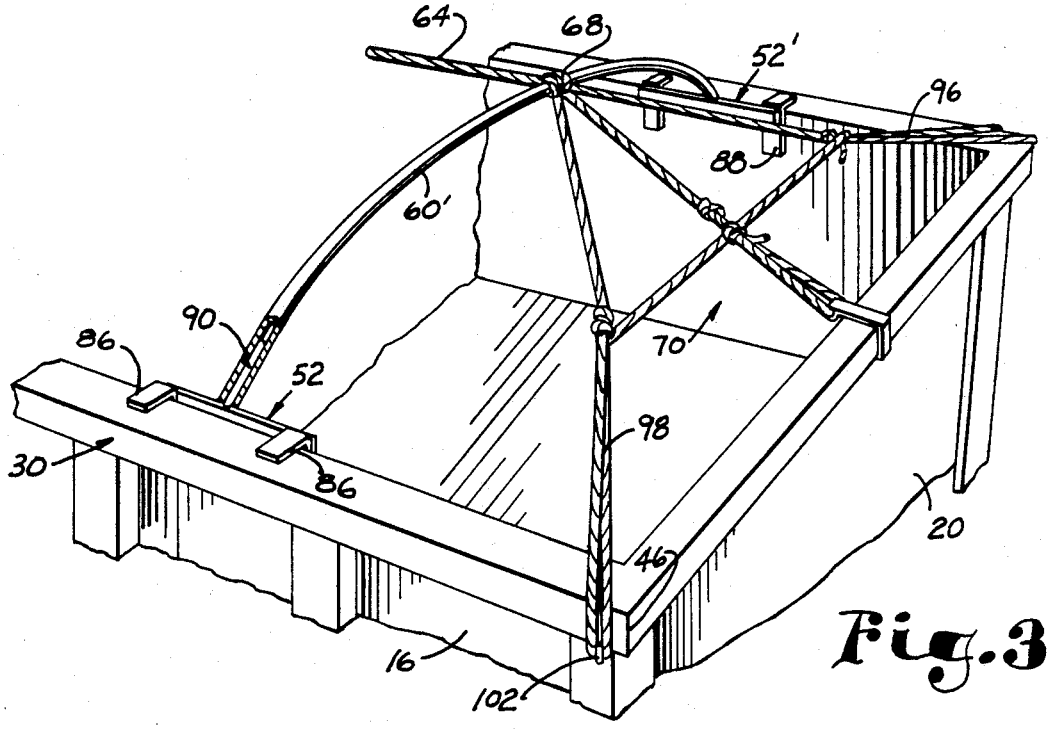
FIG. 3 is a perspective of an end adjustment and cover supporting means of the covering means of the present invention.

The adjustment and cover supporting means 70 is best shown in FIG. 3, and attention is now directed to such figure. As shown in FIG. 3, the adjustment and cover supporting means 70 includes a pair of corner tether lines 96, 98, each of which is attached at one end thereof to the endmost rib 60' or 60'' adjacent to the ridge line means rib attaching means (knots) 68 and has the other end thereof removably attached to the vehicle rim 30 adjacent to the corners thereof, such as rim corner 46. The attachment of the tether lines to the vehicle is preferably by means of hooks, such as bent wire GS hooks 102 (FIG. 10) which attach to the underside of the rim (see, e.g., FIG. 6 and FIG. 7 for two forms of attachment between GS hooks and the vehicle). If the FIG. 6 form of GS hook is used, the rim 30 will include openings, such as opening 104, defined therein adjacent to the rim corners. It is noted that the hooks should not be attached to the ladders 34 as such element may be a safety hazard on a ladder.

The tether lines 96, 98 can be intertwined with each other and attached to the hook 66 of the ridge line means 64 as necessary to define a taut network of lines between the endmost cover supporting rib 60' or 60'' and the end of the vehicle. The intertwining can be effected by merely looping the lines together, or by forming knots at the intersections of the lines.

Alternatively, an additional tether line can be included. In such case, the tether lines 96, 98 are attached to the endmost cover supporting rib and to the rim of the vehicle, and the additional tether line is knotted around these two tether lines at a location between the endmost cover supporting rib and the hook 66 and is attached to the hook 66 to form a sort of triangle support. The additional tether line can be pulled as necessary to position the attachment thereof to the tether lines 96, 98 as needed to set the adjustment and cover supporting means 70 to account for the dimensional variations of the vehicle with respect to the standard cage dimensions.

At any rate, the tether lines 96, 98 are attached to the endmost rib and to the hook 66 and to the vehicle in a manner to tightly connect the endmost rib to the vehicle and to stretch out the ridge line means 64 to set up the cage 50 on a vehicle that has an axial length that is different from the axial length of the cage as measured between the endmost ribs 60' and 60''.

Figure 7:
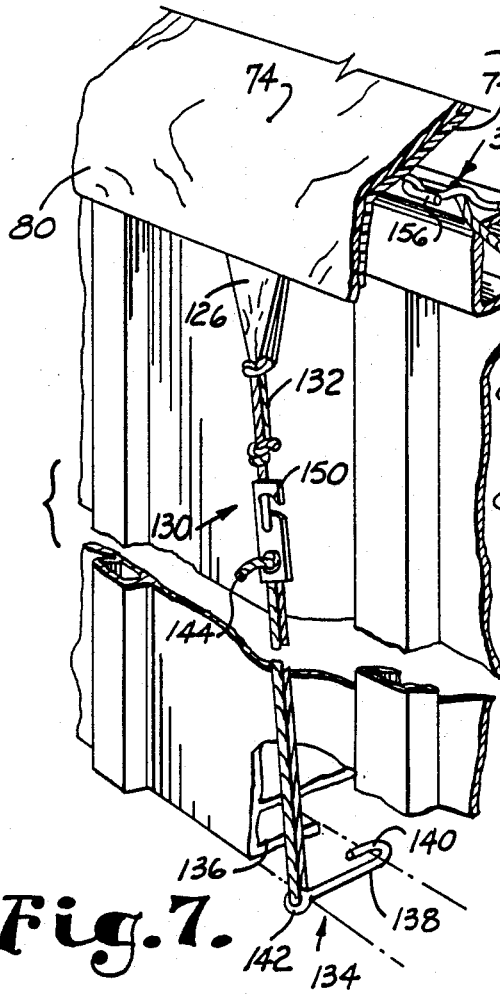
FIG. 7 is a perspective showing a side attachment means and an end attachment means for the covering means.

The flexible cover 74 is shown in FIG. 7 and includes ends, such as end 76, and sides, such as side 80. A plurality of lobar elements 126 are integrally attached to the cover at the spaced-apart locations along the sides thereof. Preferably, the cover is monolithic, and is sized to be longer, as measured between its ends, than the axial length of the longest vehicle with which it will be used, and to have a width, as measured between its sides, that is wider than the width of the widest vehicle with which it will be used. The cover will thus initially have an overlap on both the sides and the ends of the vehicle as indicated in FIG. 7. This overlap will be taken up when the cover is placed in position on the vehicle as will be more fully discussed below. The cover is placed on top of the cage 50 and on top of the adjustment and cover supporting means 70 after these two systems have been set up on the vehicle. The manner of placing the cover on these systems will be more fully discussed below.

Each of the lobar elements 126 is attached to the vehicle by a cinching means 130. Each cinching means 130 includes a tie line 132 connected to the lobar element and to a hook 134. The hooks 134 are attached to a lower rim 136 of the vehicle, and can be GS hooks 102 which include a body 138 and a hairpin end 140 on one end and a line attaching eye 142 on the other end thereof (FIG. 10). The tie lines 132 are threaded through the hook eyes and have an end 144 which is attached to a tie-down line connector 150. The tie-down line connector 150 functions in the manner of a turnbuckle to tighten the line holding the cover to the vehicle. It is noted that the tie line 132 can be attached to the lobar element 126, to the hook 134 and to the connector 150 in any suitable manner, and the knots located and shown in FIG. 7 are merely examples of such connection.

Figure 8:
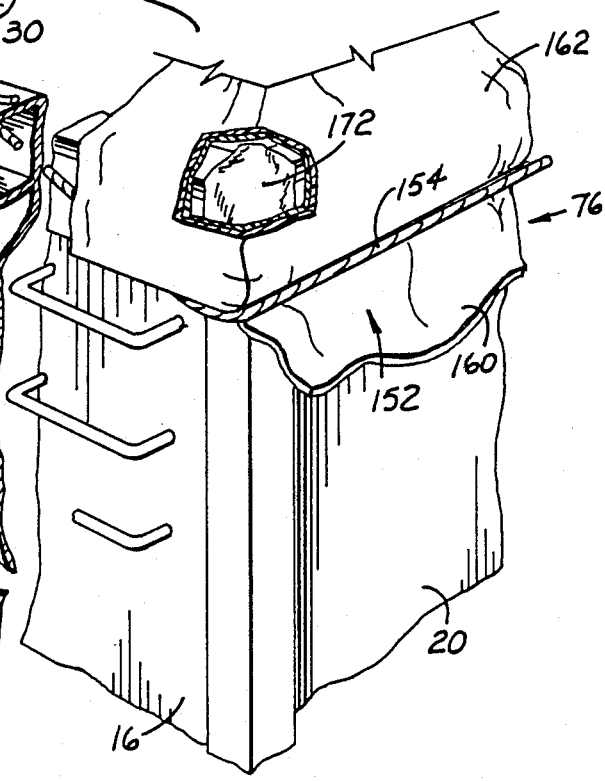
FIG. 8 is a perspective showing the formation of a multi-ply end joint for the covering means.

The ends of the cover are attached to the vehicle adjacent to the ends of the vehicle in a manner that is both efficient and secure. Referring to FIGS. 7 and 8, it can be seen that the attachment between the end of the cover and the end of the vehicle includes a truss means 152 having a line 154 extending around the end of the vehicle and attached at each end thereof to the sides of the vehicle adjacent to the corners 46 of the rim by hooks, such as hook 156 shown in FIG. 7. The line 154 extends over the end of the cover as shown in FIG. 7 to form a tail 160 extending beneath the truss line 154 and a cover body 162 extending above the truss line 154.

A multi-ply joint 180 is formed at each end of the cover by turning the tail 160 over the truss line and attaching it to the body 162 adjacent to the truss line to form a hem 182 with the truss line inside that hem as indicated in FIG. 8.

The upturned tail 160 is welded to the body 162 by the application of heat to the folded up tail.

The multi-ply in situ formed joint thus formed will be essentially continuous and monolithic across essentially the entire width of the vehicle, and thus will be stronger than attachments that are point attachments. It is noted that the sides of the cover can be attached by point attachments formed by the side attaching means as the wind is not as likely to damage the vehicle from the side since the vehicle is generally moving with one of its ends into the wind.

This application of heat can also be carried out in a manner that serves to shrink the cover against the cinching means to take up looseness in the cover which results because the cover is deliberately sized larger than the vehicle to make the cover universal in nature. Heat can be applied by means of a hand-held heat gun, such as a propane-fueled heat gun 170 shown in FIG. 8. However, other heat generating means can also be used without departing from the scope of the present invention. A formed multi-ply joint 180 is shown in FIG. 4 to be located adjacent to the vehicle end 20, and it is noted that a multi-ply joint is also formed adjacent to the vehicle end 22.

Patches, such as corner patch 172 shown in FIG. 4, can be formed in situ by removing pieces of the cover tail prior to heat sealing that tail to the cover body, and heat sealing those patches to the cover adjacent to the rim corners, or to any other suitable location on the cover by means of the heat gun. In fact, the multi-ply joints 180 can also be further reinforced by such patches if suitable. These patches, corner or otherwise, thus form a multi-ply thickness for the cover at locations deemed to be in need of reinforcement.

The fully formed and set up cover is shown in FIG. 4 on the vehicle. As seen in FIG. 4, the cover is tightly set on the vehicle, and includes double and multi-ply areas. Yet, the cover is easily set up and taken off of the vehicle.

Accordingly, the cover is placed on a vehicle in the following manner. The cover and cage assemblies along with the adjustment and cover supporting means and the cover end truss means and side tie down means are provided in a kit which is "universal" in that it is applicable to a wide variety of open-topped vehicles and vehicle sizes. The kit is used by mounting the brackets 52 on the vehicle sides 16, 18, attaching the ridge line means to the ends of the vehicle, and positioning the cover supporting ribs attached to the ridge line means adjacent to the cooperative pairs of rib mounting brackets. The brackets are moved according to the preset location of the ribs on the vehicle attached ridge line means, and the ribs are attached to the brackets. The adjustment and cover supporting means 70 are then attached to the cage 50 and to the vehicle to set the cage and the cover supporting ribs in a proper set-up configuration, and the flexible cover 74 is unrolled enough to form a tail adjacent to one end of the vehicle. The cover in situ multi-ply end joint is then formed using the application of heat to a hem 182 formed by folding the tail upwardly over the truss line 154 against the body of the cover located above that truss line. The cover is then unrolled over the set-up end and cover supporting means, the set-up cage and the adjustment and cover supporting means on the other end of the car. The sides of the cover are attached to the vehicle by means of the side cinching means 130 and the other end of the cover is attached to the vehicle by means of the end truss means 152 at that end of the vehicle. In the preferred set-up procedure, the side cinch means are attached as the cover is being unrolled.

Any patches, such as patch 172, are formed and attached to the cover as needed. Heat can also be applied to the cover at various locations to shrink it as necessary to securely and closely fit the vehicle.

It is also a simple matter to remove the cover from the vehicle by simply removing the side cinching means, detaching the end truss means truss lines 154 from the vehicle, and removing the cover from the vehicle.

It is to be understood that while certain forms of the present invention have been illustrated and described herein, it is not to be limited to the specific forms or arrangement of parts described and shown.

What is claimed and desired to be secured by Letters Patent is as follows:

1. In combination with a normally open-topped vehicle inherently having upstanding side walls and end walls, a removable covering means comprising:

(a) a flexible cover having ends and sides; and (b) a cover supporting means for supporting said flexible cover in covering relation with respect to the open-topped vehicle, said cover supporting means including:

(1) a plurality of removable rib supporting brackets mounted on the side walls of the vehicle, with brackets on each vehicle side wall being adjustably longitudinally spaced apart from each other and each bracket on each vehicle side wall having a corresponding bracket on the other vehicle side wall to form cooperative pairs of brackets;

(2) a cover supporting rib associated with each cooperative pair of brackets, each cover supporting rib extending across the vehicle between the side walls of the vehicle and having an end connected to each of the brackets of each cooperative pair of brackets;

(3) a flexible ridge line means extending axially of the vehicle between the end walls of the vehicle for supporting said flexible cover and for establishing preset spacings between adjacent cover supporting ribs, said ridge line means having ends, with each ridge line means end being connected to one of the vehicle end walls, said ridge line means including a plurality of rib attaching means thereon for fixedly attaching said ribs to said ridge line means whereby said ribs are axially supported at said rib attaching means, said rib attaching means being spaced apart from each other along the length of said ridge line means a predetermined distance so that upon attaching said ribs to said ridge line means by said rib attaching means, said preset spacing between adjacent cover supporting ribs is established; and (4) cover attachment means for attaching said flexible cover to said cover supporting means.

2. The covering means defined in claim 1, which includes an adjustment and cover supporting means attached to each end wall of the freight vehicle, each of said adjustment and cover supporting means being connected to said ridge line means and to an end rib of said cover supporting ribs for setting a distance between said end rib and the adjacent end wall of the vehicle, which distance corresponds to a predetermined portion of a difference between an overall axial length of the vehicle and a distance existing between said end rib and an end rib located adjacent to the other vehicle end wall whereby variations in vehicle axial length are taken up by said adjustment and cover supporting means so that the preset spacing between ribs is amenable for use on a wide variety of vehicles.

3. The covering means defined in claim 1 wherein said cover attachment means includes end truss means for attaching said flexible cover ends to the end walls of the vehicle.

4. The covering means defined in claim 3 wherein at least one end of said flexible cover being attached to one end truss means by a multi-ply joint formed by folding a first portion of said flexible cover around said one end truss means to overlap a second portion of said flexible cover means and applying heat to said cover to weld said first cover portion to said second cover portion with said one end truss means between said cover portions.

5. The covering means defined in claim 1 wherein said flexible cover has properties that permit it to be shrinkable and self-weldable by application of heat thereto.

6. The covering means defined in claim 1 wherein the open-topped vehicle is a freight vehicle.

7. The covering means defined in claim 2 wherein said predetermined portion is approximately one-half of said difference between the overall axial length of the vehicle and the spacing existing between said end ribs.

8. The covering means defined in claim 2 further including corner protecting means associated with at least one corner of the vehicle as formed by an intersection between one vehicle side wall and one vehicle end wall, said corner protecting means being formed by welding a piece of said flexible cover to that portion of said flexible cover located adjacent to said one corner.

9. The covering means defined in claim 1 further including side attachment means for attaching the sides of said flexible cover to the side walls of the vehicle.

10. The covering means defined in claim 9 wherein said side attachment means includes a plurality of spaced-apart lobar elements on each side of said flexible cover, tie lines attached to said lobar elements and adjustable cinch means in said tie lines.

11. The covering means defined in claim 1 wherein said cover supporting ribs are arcuate in axial shape.

12. The covering means defined in claim 2 wherein said preset spacings are about eight and one-half feet each.

13. A covering means for an open-topped vehicle having side walls and end walls and which is subject to having a variety of axial lengths as measured between the end walls thereof, the covering means including:

(a) a flexible cover having ends and sides and which is formed of a material which is shrinkable and self-weldable by the application of heat thereto;

(b) a cover supporting means for supporting said flexible cover in covering relation on the open-topped vehicle, said cover supporting means including:

(1) a plurality of rib supporting brackets which are adapted to be longitudinally movably mounted on the side walls of the vehicle;

(2) a plurality of cover supporting ribs each of which is sized to extend across the vehicle from one vehicle side wall to another vehicle side wall and each of which includes opposite ends connected to a respective cooperative pair of brackets, said cover supporting ribs and said rib supporting brackets being adapted to form a cover supporting cage on the vehicle which cage has a predetermined axial length measured with respect to the axial length of the vehicle; and (3) a flexible ridge line means for supporting said flexible cover and for establishing preset spacings between adjacent supporting ribs when such supporting ribs are mounted on the vehicle, said ridge line means having ends and a plurality of rib attaching means for fixedly attaching said ribs to said ridge line means whereby said ribs are axially supported at said rib attaching means, said rib attaching means being space apart from each other along the length of said ridge line means at predetermine distances so that upon attaching said ribs to said ridge line means by said rib attaching means, preset spacings between adjacent ribs are established;

(c) an adjustment and cover supporting means having means for setting a distance between an end rib of said cover supporting ribs and end wall of the vehicle which distance corresponds to a predetermined portion of the difference between the overall axial length of the vehicle and the axial length of said cage whereby variations in vehicle axial length can be accounted for by said adjustment and cover supporting means so that the preset spacings between adjacent ribs is amenable for use on a wide variety of vehicles;

(d) cover attachment means for attaching said flexible cover to the vehicle, said cover attachment means including end truss means for attaching said flexible cover ends to the end walls of the vehicle; and (e) said flexible cover having an axial length as measured between the ends thereof that is sufficient to exceed the axial length of any vehicle on which it will be used by an amount sufficient to form a flap that is sized and dimensioned to be folded back upon itself with an end truss means captured therein so said cover can form a double ply joint with said end truss means inside when heated to weld the flap to the remainder of the flexible cover.

14. In combination with a normally open-topped vehicle inherently having upstanding side walls and end walls, a removable covering means comprising:

(a) a flexible cover having ends and sides and which comprises polyethylene with properties that permit it to be shrinkable and self-weldable by the application of heat thereto;

(b) a cover supporting means for supporting said flexible cover in covering relation with respect to the open-topped vehicle, said covering means including a cage means of standard length attached to the vehicle side walls;

(c) an adjustment and cover supporting means attached to each end wall of the vehicle, each of said adjustment and cover supporting means being connected to one end of said cage means for setting a distance between said cage one end and the adjacent end wall of the vehicle which distance corresponds to a predetermined portion of the difference between the overall axial length of the vehicle as measured between the end walls of the vehicle and the distance existing between said cage means one end and the other end of said cage means whereby variations in vehicle axial length can be taken up by said adjustment and cover supporting means so that the standard length of said cage means is amenable for use on a wide variety of vehicle axial lengths;

(d) cover attachment means for attaching said flexible cover to said cover supporting means, said cover attachment means including end truss means for attaching said flexible cover ends to the end walls of the vehicle; and (e) at least one end of said flexible cover being attached to an end truss means by a double-ply joint formed by folding a first portion of said flexible cover back against a second portion of said flexible cover and around said one end truss means to form a hem with said one end truss means inside said hem and applying heat to said cover to weld said one cover portion to said second cover portion with said one end truss means inside said hem.

15. In combination with a normally open-topped vehicle inherently having upstanding side walls and end walls, a removable covering means comprising:

(a) a flexible cover having ends and sides; and (b) a cover supporting means for supporting said flexible cover in covering relation with respect to the open-topped vehicle, said cover supporting means including:

(1) a plurality of removable rib supporting brackets longitudinally movably mounted on the side walls of the vehicle, with brackets on each vehicle side wall being adjustably longitudinally spaced apart from each other and each bracket on each vehicle side wall having a corresponding bracket on the other vehicle side wall to form cooperative pairs of brackets;

(2) a cover supporting rib associated with each cooperative pair of brackets, each cover supporting rib extending across the vehicle between the side walls of the vehicle and having an end connected to each of the brackets of each cooperative pair of brackets;

(3) a flexible ridge line means extending axially of the vehicle between the end walls of the vehicle for supporting said flexible cover and for establishing preset spacings between adjacent cover supporting ribs, said ridge line means having ends, with each ridge line means end being connected to one of the vehicle end walls, said ridge line means including a plurality of rib attaching means thereon for fixedly attaching said ribs to said ridge line means whereby said ribs are axially supported at said rib attaching means, said rib attaching means being spaced apart from each other along the length of said ridge line means a predetermined distance so that upon attaching said ribs to said ridge line means by said rib attaching means, said preset spacing between adjacent cover supporting ribs is established; and (4) cover attachment means for attaching said flexible cover to said cover supporting means.

* * * * *